US005211110A

United States Patent [19]

Maesawa et al.

[11] Patent Number: 5,211,110

[45] Date of Patent: May 18, 1993

[54] HAMMER BANK ROCKING DEVICE IN IMPACT DOT LINE PRINTER

[75] Inventors: Hiroyuki Maesawa; Kazumasa Mizoguchi, both of Iruma, Japan

[73] Assignee: Ye Data Inc., Tokyo, Japan

[21] Appl. No.: 851,945

[22] Filed: Mar. 13, 1992

[30] Foreign Application Priority Data

Mar. 15, 1991 [JP] Japan ..... 3-128817

[51] Int. Cl.[5] ..... B41J 3/00

[52] U.S. Cl. ..... 101/93.05; 400/341

[58] Field of Search ..... 101/93.05, 93.09, 93.15, 101/93.16, 93.17, 93.48, 93.04, 93; 400/341, 323

[56] References Cited

U.S. PATENT DOCUMENTS 4,415,286 11/1983 Jennings ..... 101/93.04
4,741,267 5/1988 Lipkovker et al. ..... 101/93.05
4,764,040 8/1988 Whitaker ..... 101/93.16

*Primary Examiner*—Edgar S. Burr

*Assistant Examiner*—Anthony H. Nguyen

*Attorney, Agent, or Firm*—Wenderoth, Lind & Ponack

[57] ABSTRACT

An impact dot line printer has a hammer bank equipped with a plurality of printing heads along printing lines mounted on the upper side of a belt extended between a pair of rotational drums. A counter balancer is mounted on the lower side thereof, the hammer bank and the counter balancer being reciprocated in the directions reverse to each other. Since repelling springs are provided on both left and right sides in order to reduce thrust required for deceleration at the end of shuttling operation of the hammer bank and the counter balancer, vibrations or noises caused by the collisions with the spring might occur. But by the present invention, rotors are provided with eccentric weights which act so as to offset force couple at the time of the collisions with the repelling springs, whereby the shock force caused by the collisions is sharply decreased to suppress the vibrations or noises.

4 Claims, 2 Drawing Sheets

HAMMER BANK ROCKING DEVICE IN IMPACT DOT LINE PRINTER

BACKGROUND OF THE INVENTION AND PRIOR ART

The present invention relates to a hammer bank rocking device in an impact dot line printer equipped with a plurality of printing heads along printing lines.

FIG. 1 shows a structure of a conventional linear motor type impact dot line printer. Reference numeral 1 designates a hammer bank equipped with a plurality of printing heads along printing lines; 3 a hammer bank mounting bed provided with repelling portions 3*a* and 3*b*; and 9 a coil core plate and counter balancer provided with repelling portions 9*a* and 9*b* and equipped with coils 8 and 8'.

The counter balancer 9 is provided in parallel with the hammer bank mounting bed 3 and connected to upper and lower portions of a belt 5 extended between rotational drums 4 and 4' provided on opposite sides thereof so that the counter balancer 9 and the hammer bank 1 are rocked in a direction reverse to each other.

The coils 8 and 8' face permanent magnets 6 and 6', respectively, of a magnetic circuit comprising permanent magnets 6 and 6' and a yoke 7 secured to a frame (not shown). When a reverse current is supplied to the coils 8 and 8' at regular intervals, the counter balancer 9 and the hammer bank 1 are rocked in the directions reverse to each other.

Reference numerals 10-1, 10-2, 10-3 and 10-4 designate repelling springs provided on opposite sides in order to reduce the thrust required for deceleration at the end of the rocking stroke of the hammer bank 1 and the counter bank 9. Reference numeral 11 designates an ink ribbon; 12 a printing paper; and 13 a platen.

In the conventional hammer bank rocking device shown in FIG. 1, the hammer bank mounting bed 3 and the counter balancer 9 simultaneously collide with the left and right repelling springs opposed to each other at the end of the shuttling operation. However, in the conventional construction shown in FIG. 1, a couple $F_1 \times 2l_1$ is produced which is expressed by product of a force $F_1$ caused by the collision and a length $2l_1$ between axes of the hammer bank mounting bed 3 and the counter balancer 9, and as a result, a shock force by which the hammer bank mounting bed 3 is rotated acts, resulting in vibrations and noises that give rise to the lowering of printing-dot precision.

SUMMARY OF THE INVENTION

In order to solve the aforementioned problem, according to the present invention, the rotational drums 4 and 4' are each provided with a rotor having an eccentric weight which is rotated in response to movement of the hammer bank mounting bed 3 and the counter balancer 9 and acts so as to offset the couple produced when the repelling portions 3*a*, 3*b* and 9*a*, 9*b* collide with the repelling springs so as to sharply decrease the shock force by which the hammer bank 1 is rotated.

FIG. 2 is a view explaining the principle of the present invention. Rotors 14 and 14' according to the present invention have eccentric weights 15 and 15', respectively, engage with gears 16 and 16' rotating together with rotational drums 4 and 4', respectively, and rotate in the direction reversed to the rotational drums 4 and 4'.

Assume now that the counter balancer 9 collides with the repelling spring 10-1 at speed $x_1$, operational data of parts are expressed by formulae as follows:

$$r_1\theta_1 = x_1 \tag{1}$$

$$r_2\theta_1 = r_3\theta_3 \tag{2}$$

Acceleration $x_3$ in a tangential direction of the eccentric weight 14 is expressed by the following formula (3) from the above-described formulae (1) and (2).

$$x_3 = r_3\theta_3 = \frac{r_2}{r_1} x_1 \tag{3}$$

Assume that time immediately before the counter balancer 9 collides with the repelling spring is taken as original point of time, $x_1$ and $x_3$ are expressed by formula (4) below:

$$\left.\begin{aligned} x_1 &= \delta \sin \omega_n t \\ x_3 &= \frac{r_2}{r_1} \delta\omega_n^2 \sin\omega_n t \end{aligned}\right\} \tag{4}$$

wherein $\omega_n$ represents the natural frequency.

Accordingly, the tangential force $F_2$ acting on the eccentric weight is given by the following formula (5):

$$F_2 = m_2 x_3 = m_2 \frac{r_2}{r_1} \delta\omega_n^2 \sin \omega_n t \tag{5}$$

Thereby, the couple $M_2$ produced by $F_2$ is expressed by the following formula (6).

$$M_2 = m_2 \frac{r_2}{r_1} \delta\omega_n^2 l_2 \sin \omega_n t \tag{6}$$

On the other hand, so the eccentric weight should remain at the same position when the counter balancer collides with the right end and the left end, the relationship of the following formula (7) exists:

$$r_2 = \frac{r_1 r_3 \times 2\pi}{S} \tag{7}$$

$M_2$ is given by the following formula (8) from formulae (6) and (7).

$$M_2 = \frac{2\pi m_2 r_3 \delta l_2 (k/m_1) \sin \omega_n t}{S} \tag{8}$$

Further, the couple $M_1$ produced when the counter balancer collides is expressed by the following formula (9):

$$M_1 = F_1 r_1 = \delta k (\sin \omega_n t) r_1 \tag{9}$$

Accordingly, the vibration is sharply decreased by setting data so that the couple M produced when the counter balancer 9 collides and the couple $M_2$ produced by the tangential force $F_2$ acting on the eccentric weight are offset. That is, if the setting conditions of data are given by the following formula (10) derived from formulae (8) and (9), the vibration can be suppressed.

$$m_2 = m_1 \frac{r_1 S}{2\pi r_2 l_2} \quad (10)$$

DESCRIPTION OF THE PREFERRED EMBODIMENTS

Figure 1:
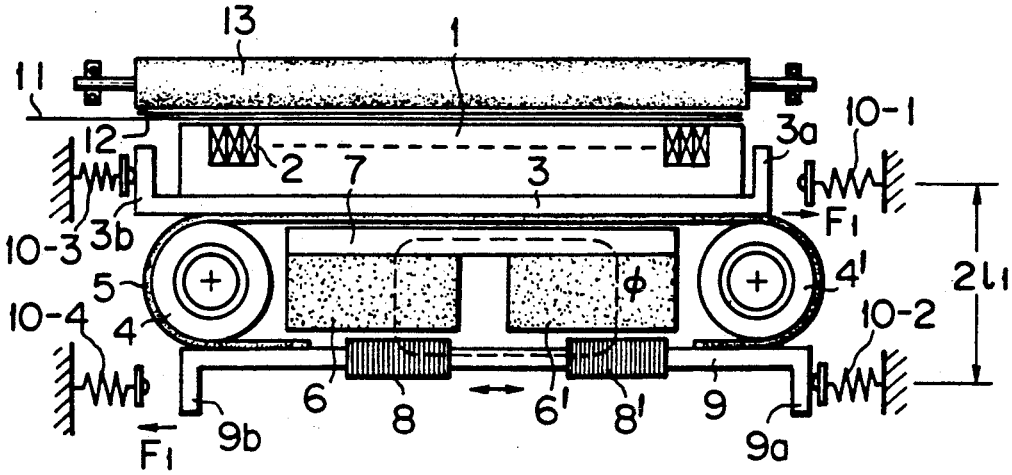
FIG. 1 PRIOR ART
FIG. 1 is a side view of a conventional device.
Figure 3:
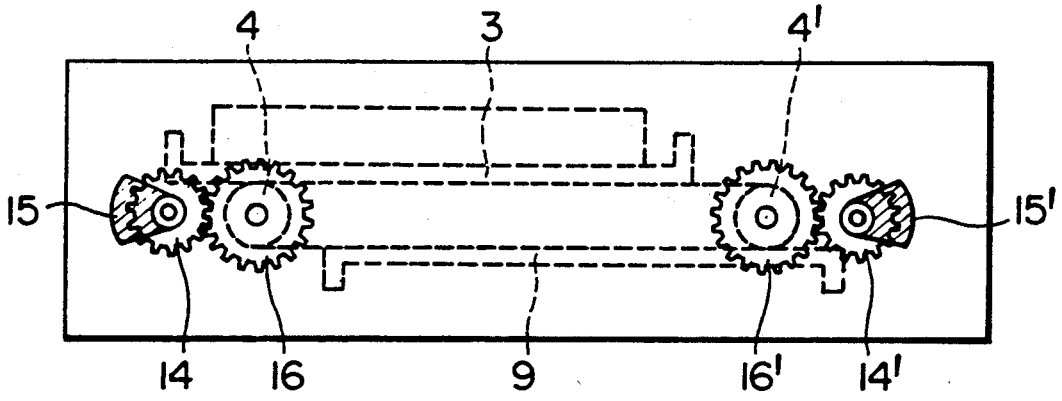
FIG. 3 is an explanatory view of an embodiment of the present invention.
Figure 2:
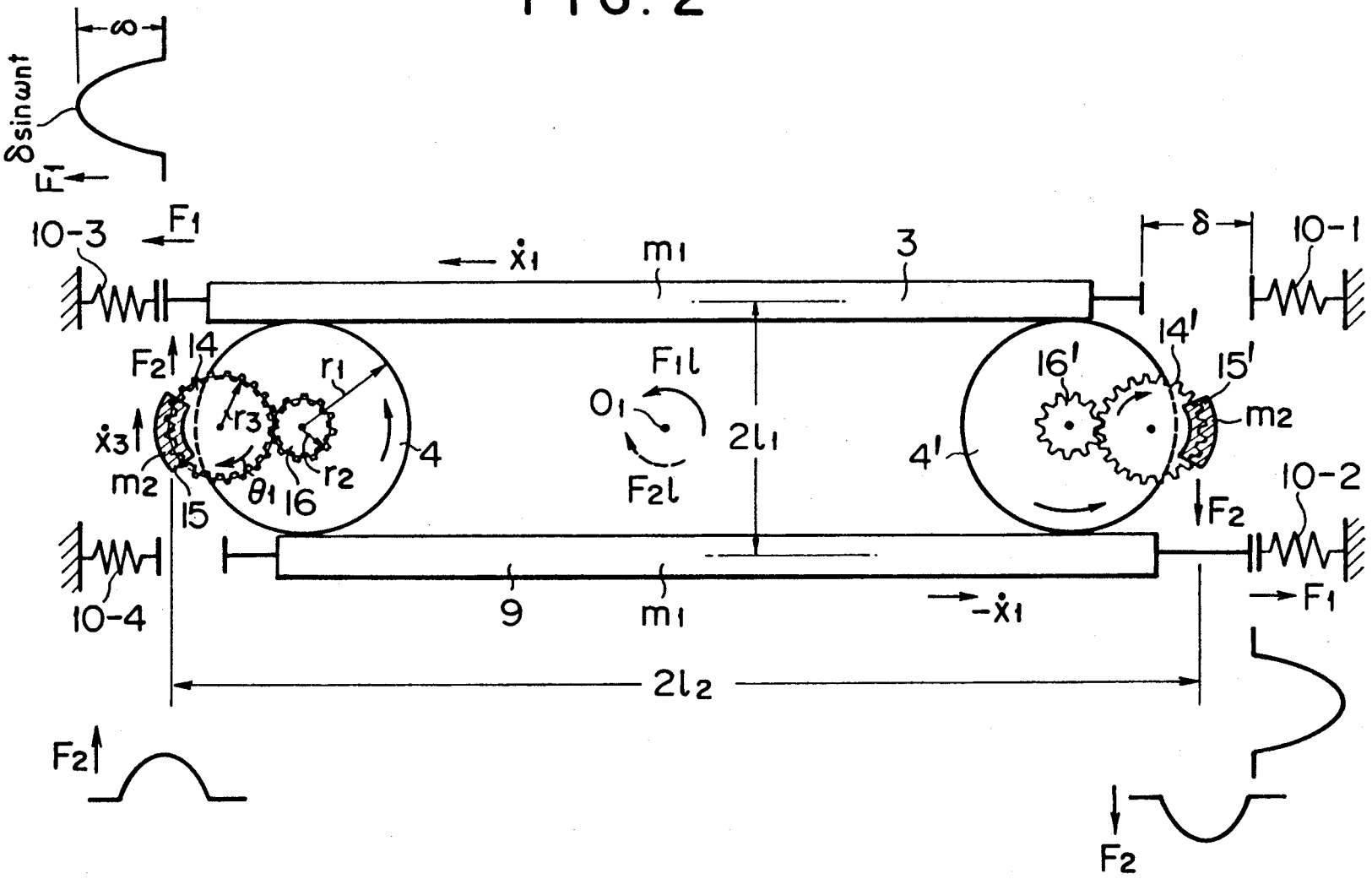
FIG. 2 is a view for explaining the principle of the present invention.

FIG. 3 shows an embodiment according to the present invention. Rotors (gears) 14 and 14' having eccentric weights 15 and 15', respectively, are rotated in the direction reversed to rotational drums 4 and 4' through gears 16 and 16' rotating together with the rotational drums 4 and 4'.

More specifically, when the counter balancer 9 moves rightward, the rotational drums 4 and 4' rotate counterclockwise, and the eccentric weights 15 and 15' rotate clockwise through the gears 16 and 16' and the rotors 14 and 14'.

Conversely, when the counter balancer 9 moves leftward, the eccentric weights 15 and 15' rotate counterclockwise.

It is to be noted that the gear ratio is set so that at the time of collision with the right end and left end, the eccentric weights 15 and 15' assume the same position.

With this structure, the couple produced when the hammer bank 1 and the counter balancer 9 collide with the repelling springs 10-1, 10-2, 10-3 and 10-4 is offset by the couple produced by the tangential force of the eccentric weights 15 and 15'.

Accordingly, the couple applied to the printer casing is 0, enabling suppression of vibrations.

According to the present invention, since the vibration of the printer casing itself during operation of the printer is decreased, the quality of print can be improved, and this device is useful particularly in the case where the printing speed is increased.

What is claimed is:

1. A hammer bank rocking device, comprising:

a pair of rotatably mounted drums;

a belt extending around said drums for movement thereon;

a hammer bank mounted on said belt, said hammer bank having a plurality of printing heads along printing lines;

a counter balancer mounted on said belt for counterbalancing said hammer bank;

wherein said hammer bank and said counter balancer are mounted to said belt such that when said belt is moved on said rotatably mounted drums said hammer bank and said counter balancer move in opposite directions; and a pair of rotors connected to said rotatably mounted drums such that each said rotor rotates in a direction opposite to the direction of rotation of its respective said rotatably mounted drum, each said rotor having an eccentric weight.

2. The hammer bank rocking device of claim 1, wherein said pair of rotors are gears, and said rotatably mounted drums have respective gears engaging said rotors.

3. A hammer bank rocking device for an impact dot line printer, comprising:

a pair of rotatably mounted drums;

a belt extending around said drums for movement thereon;

a hammer bank mounted on said belt, said hammer bank having a plurality of printing heads along printing lines;

a counter balancer mounted on said belt for counterbalancing said hammer bank;

rocking means for rocking said hammer bank and said counter balancer back and forth wherein said hammer bank and said counter balancer are mounted to said belt such that when said belt is moved on said rotatably mounted drums said hammer bank and said counter balancer move in opposite directions, and wherein when said rocking means changes the direction of movement of said hammer bank and said counter balancer, a couple is produced; and eccentric means for producing a second couple opposite to the first said couple, said eccentric means comprising a pair of rotors connected to respective said rotatably mounted drums such that each said rotor rotates in a direction opposite to the direction of rotation of its respective said rotatably mounted drum, each said rotor having an eccentric weight.

4. The hammer bank rocking device of claim 3, wherein said pair of rotors are gears, and said rotatably mounted drums have respective gears engaging said rotors.

* * * * *